United States Patent [19]

Weiskopf

[11] 4,360,111

[45] Nov. 23, 1982

[54] CRANE WITH TELESCOPIC JIB

[75] Inventor: Hans Weiskopf, Hilden, Fed. Rep. of Germany

[73] Assignee: Leo Gottwald KG, Düsseldorf, Fed. Rep. of Germany

[21] Appl. No.: 144,925

[22] Filed: Apr. 29, 1980

[30] Foreign Application Priority Data

May 3, 1979 [DE] Fed. Rep. of Germany ..... 2917829

[51] Int. Cl.[3] ..... B66C 23/76

[52] U.S. Cl. ..... 212/196

[58] Field of Search ..... 212/195, 196, 230, 231, 212/232, 237, 238, 239, 245, 260, 261, 264

[56] References Cited

U.S. PATENT DOCUMENTS

| | | | |
|---|---|---|---|
| 2,130,487 | 9/1938 | Foley | 212/196 X |
| 3,375,021 | 3/1968 | Grider | 212/196 X |
| 3,924,753 | 12/1975 | Lamer et al. | 212/196 X |

FOREIGN PATENT DOCUMENTS

| | | | |
|---|---|---|---|
| 2306927 | 11/1976 | France | 212/196 |
| 1072910 | 6/1967 | United Kingdom | 212/196 |

*Primary Examiner*—James L. Rowland

*Attorney, Agent, or Firm*—Toren, McGeady & Stanger

[57] ABSTRACT

A mobile crane having a telescopic jib 15 which is mounted on an upper chassis 8 has a cantilever counterweight 14 and an additional removable counterweight 27. The additional counterweight 27 is carried on a holder 28 which is mounted on a strut 21 which is directly pivotally connected to the jib 15. The strut 21 can be pivoted to raise and lower the holder 28 to enable the additional counterweight 27, which is removable, to be picked up and deposited. The additional counterweight 27 is deposited and removed to lighten the crane for road travel, but when operative, increases the lifting capacity of the crane.

12 Claims, 1 Drawing Figure

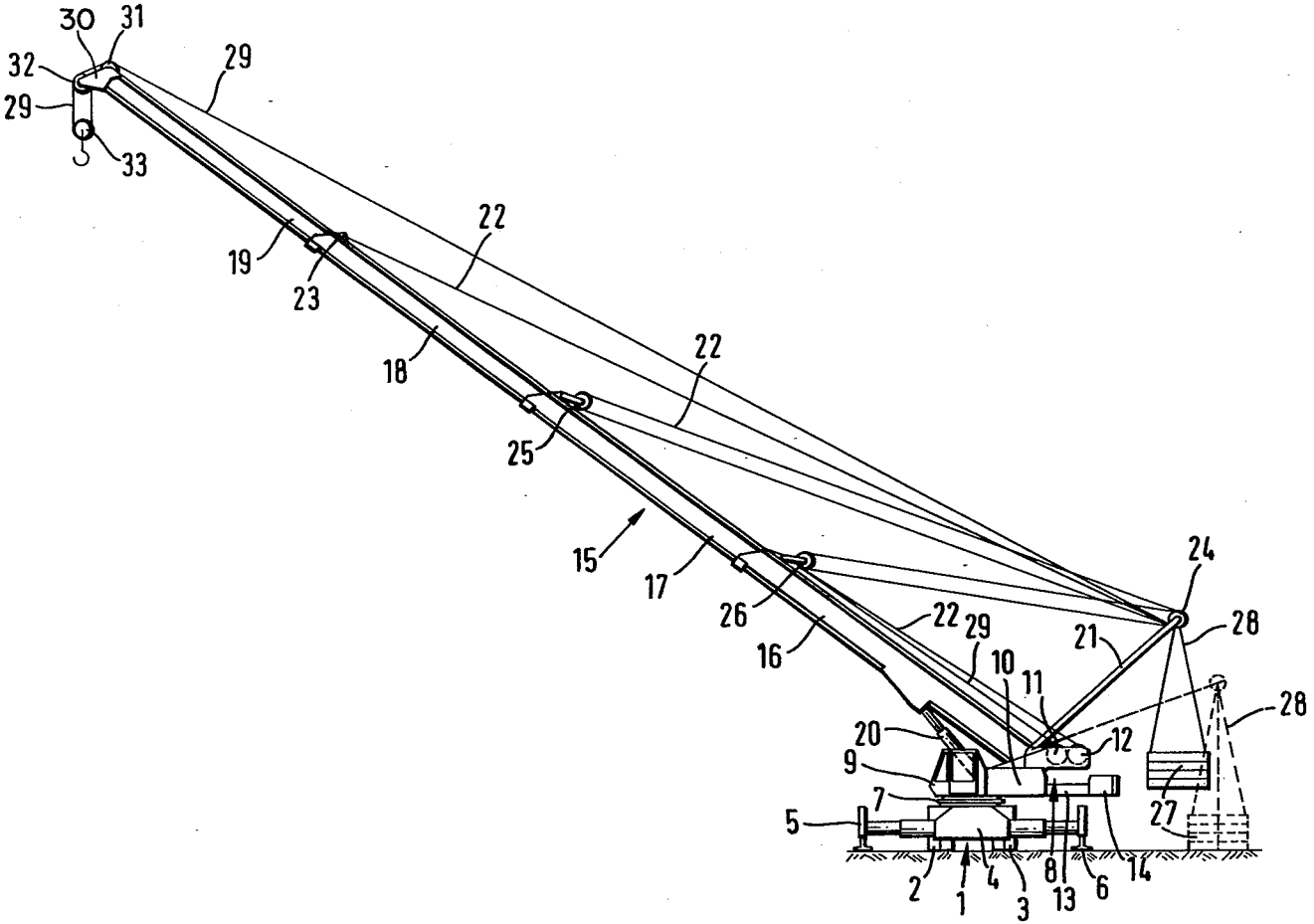
28
28
24
27
14
12
6
21
13
8
11
3
10
4
29
1
22
2
20
9
7
5
16
26
22
17
15
25
22
18
23
19
29
31
33
30
32
29

CRANE WITH TELESCOPIC JIB

This invention relates to cranes, particularly mobile cranes, comprising a telescopic jib which has a hoist rope and is pivotally mounted on a rotatable upper chassis.

Road vehicle-mounted cranes frequently have telescopic jibs, which comprise a plurality of tubular sections capable of sliding telescopically inside each other. These telescopic jibs are pivoted at their foot about a horizontal axis on an upper chassis of the crane. The pivoting about this axis is usually effected by one or more hydraulic luffing cylinders, which are attached at one end to the upper chassis and at the other end to the lowest telescopic portion of the jib. The upper chassis is mounted as a whole by means of a rotary connection on a carriage which forms a motorized truck.

The upper chassis has a rearwardly cantilevered beam carrying a counter-weight, which counteracts at least partially the tilting moment of the forwardly cantilevered telescopic jib and the load, which is in use suspended from it, in order to increase the lifting capacity of the crane and to some extent also to relieve of load the rotary connection between upper chassis and the carriage. This counter-weight must not be of excessive weight, amongst other things primarily in order that the vehicle-mounted crane shall not exceed the maximum permissible total weight or permissible single axle weight for road load transportation. This requirement naturally limits the maximum possible lifting capacity of the telescopic jib. In addition, this lifting capacity is also determined by the force that can be accepted by the hydraulic luffing cylinder and by the bending strength and buckling strength of the telescopic jib.

The aim of the present invention is to increase the lifting capacity of a crane comprising a telescopic jib, which has a hoist rope and is pivoted on a rotatable upper chassis, and a counterweight.

To this end, according to this invention, such a crane is provided with a holding and raising device on the upper chassis for picking up an additional removable counterweight from the ground and holding this counterweight.

By the provision of such a holding and raising device on the upper chassis, one or more additional counterweights can be accommodated when required, as a result of which the lifting capacity is increased and, depending upon the use of the crane, the rotary connection between the upper chassis and the carriage is relieved of load, without the total weight of the crane, in the case of a vehicle-mounted crane, for travelling being thereby increased, since the additional counterweights can be transported on separate vehicles.

Preferably, the holding and raising device is connected directly to the telescopic jib. Apart from the reduction of the moment acting upon the rotary connection, this also results in a considerable relief of load for the luffing hydraulic cylinder when this is provided for luffing the jib, so that to this extent also higher lifting loads can be accepted.

The holding and raising device may comprise a strut directed away from the tip of the jib. The strut is preferably directed obliquely towards the rear and upwards and can be lowered for the picking up of the additional counterweight. It is of especial advantage if the strut, preferably at its free end, is connected to the telescopic jib above the pivotal connection of the jib to the upper chassis, since this results in a reduction of the bending and buckling load on the telescopic jib. In this respect, the connection of the strut to the telescopic jib at a plurality of attachment points disposed along the jib is especially favourable, since, as a result, the moment of the additional counter-weight which is transmitted to the telescopic jib can be distributed to decrease the loadings that occur. It will as a rule be advantageous to dispose the points of attachment to the jib at uniform intervals one above another, and indeed as far as possible in such a manner that a point of attachment is provided on each telescopic portion of the jib with the exception of the uppermost.

For connecting the strut to the telescopic jib, a guy rope is especially suitable. This offers the advantage that it can be used also for raising and lowering the strut for picking up the counterweight in a simple manner. The guy rope may extend from an upper fixed point on the telescopic jib to a return sheave on the strut and thence to at least one further return sheave on the jib below the fixed point, and finally to a guy rope winding drum on the upper chassis. This results in a good distribution of the forces applied by the additional counterweight to the telescopic jib, and the guy rope can still be used for raising and lowering the strut.

For large additional counterweights it may be advantageous for the guy rope to be conducted back and forth between the telescopic jib and the strut around sets of return sheaves in blocks several times to form a tackle. This can be done by providing on the telescopic jib sheave blocks disposed one above the other, to which the guy rope is conducted from the set of return sheaves on the strut.

With the construction according to this invention, the further advantage is achieved that the luffing cylinder, when provided, undergoes pressure reduction as a result of the additional counterweight, and also the cylinder is capable, in operation, of holding the additional counterweight when raised, without any live load being attached to the jib since the counterweight acts indirectly on the piston rod side of the luffing cylinder.

A further improvement in the loading conditions on the crane can be achieved by the hoist rope being arranged to pass from the upper chassis via a return sheave on the telescopic jib to a further return sheave on the strut and thence to the tip or head of the telescopic jib. For constructional reasons, it is desirable to construct the return sheaves for the hoist rope as a part of return sheave blocks for the guy rope.

An example of a road vehicle-mounted mobile crane in accordance with the invention is illustrated in the accompanying drawing which is a rear view of the carriage of the crane with its upper chassis slewed so that it is shown in side elevation.

The crane 1 has a carriage 4 which is in the form of a motorized truck, capable of travelling on wheels 2, 3. On the carriage 4, outriggers 5, 6 are extended on both sides to improve the load-bearing capacity and stability.

On the carriage 4 there is a rotary connection 7 which carries an upper chassis 8 so that it can slew. Above the rotary connection 7 there is a forwardly disposed crane driver's cabin 9, adjoined on the rear side by a drive housing 10 containing engines for driving a hoist rope drum 11 and a guy rope drum 12. A counterweight 14 is attached to a rearwardly cantilevered beam 13.

Above the drive housing 10, a telescopic jib 15 is pivoted to the upper chassis 8 at its foot to luff about a horizontal axis. It is shown extending obliquely forwards and comprises four telescopic tubular sections 16, 17, 18, 19, capable of sliding telescopically inside one another. The lowest telescopic section 16, is connected to the upper chassis 8 by a hydraulic differential luffing cylinder 20 by means of which the telescopic jib 15 can be luffed.

To the upper chassis there is also pivotally connected at one end a rearwardly and obliquely upwardly extending strut 21, which forms the main components of a holding and raising device. The strut 21 is connected at its free end via a guy rope 22 to the telescopic jib 15. The guy rope 22 leads, in the example illustrated, from a fixed point 23 disposed at the upper end of the second uppermost telescopic section 18 to a return sheave block 24 comprising a total of five return sheaves at the free end of the strut 21, thence the guy rope 22 extends twice to a further return sheave block 25 comprising two return sheaves on the upper end of the next lower telescopic section 17 and, after passing back to the strut 21, the guy rope 22 extends twice again to a return sheave block 26 at the upper end of the lowermost telescopic section 16, before it is conducted from the latter to the guy rope drum 12.

As a result of this guiding of the guy rope, the strut 21 can be lowered, by operating the guy rope drum 12, from the position shown in full lines in the drawing to that shown in broken lines in order to pick up an additional counterweight 27 (shown in broken lines) resting on the ground by means of a cable 28 or holder and then to raise the additional counterweight to an operative position shown in full lines. In this way the mobile crane 1 achieves a higher lifting capacity, because the rotary connection 7 and, due to the particular reeving of the guy rope, the hydraulic cylinder 20 are relieved of load. Furthermore, by fanning out the points of attachment of the guy rope 22 on the telescopic jib 15 to three positions, the bending and buckling stresses on the latter are considerably reduced.

The guiding of a hoist rope 29 provided for raising the main load also acts to the same effect. This rope runs from the lifting cable drum 11 along the telescopic jib 15 as far as the sheave block 26, thence to the sheave block 24 at the free end of the strut 21 and then to the jib head 30, where it is conducted over two guide sheaves or sets of sheaves 31, 32 downwards and around a lifting block 33, and thence back upwards again to the jib head 30.

As already mentioned, the guy rope 22 is also very effective when only one return sheave block is provided on the telescopic jib, this block being attached to the upper end of the lowest telescopic jib section.

I claim:

1. In a mobile crane including a carriage, an upper chassis, means mounting said upper chassis on said carriage for rotation about an upright axis, a telescopic jib, means pivotally mounting said telescopic jib on said upper chassis for luffing movement about a substantially horizontal axis, a hoist rope, means for winding in and unwinding said hoist rope, a counterweight and means mounting said counterweight for counterbalancing said jib and loads carried from said jib by said hoist rope, the improvement comprising a holding and raising device mounted on said upper chassis, said holding and raising device being operative to pick up from the ground an additional removable counterweight and to hold said counterweight, and means connecting said holding and raising device to said telescopic jib for pivoting said holding and raising device relative to said jib and for lowering and raising said device for picking up said additional counterweight.

2. A crane as claimed in claim 1, wherein said holding and raising device includes a strut, said strut being directed upwardly from said upper chassis and spaced angularly away from said jib.

3. A crane as claimed in claim 2, in which said strut projects from said upper chassis in the direction away from said jib.

4. A crane as claimed in claim 2, wherein said means connecting said strut to said jib is located on said jib above said means pivotally connecting said jib to said upper chassis.

5. In a mobile crane including a carriage, an upper chassis, means mounting said upper chassis on said carriage for rotation about an upright axis, a telescopic jib, means pivotally mounting said telescopic jib on said upper chassis for luffing movement about a substantially horizontal axis, a hoist rope, means for winding in and unwinding said hoist rope, a counterweight and means mounting said counterweight for counterbalancing said jib and loads carried from said jib by said hoist rope, the improvement comprising a holding and raising device mounted on said upper chassis, said holding and raising device being operative to pick up from the ground an additional removable counterweight and to hold said counterweight, said holding and raising device includes a strut, said strut being directed away from said jib, means connecting said strut to said jib above said means pivotally connecting said jib to said upper chassis, said means connecting said strut to said telescopic jib is attached to said strut at an end thereof remote from said jib.

6. A crane as claimed in claim 5, in which said means connecting said strut to said telescopic jib connects said strut to said jib at a plurality of attachment points on said jib disposed along the length of said jib.

7. A crane as claimed in claim 6, in which said telescopic jib includes a plurality of telescopic sections and said plurality of attachment points are disposed one on each of said sections.

8. In a mobile crane including a carriage, an upper chassis, means mounting said upper chassis on said carriage for rotation about an upright axis, a telescopic jib, means pivotally mounting said telescopic jib on said upper chassis for luffing movement about a substantially horizontal axis, a hoist rope, means for winding in and unwinding said hoist rope, a counterweight and means mounting said counterweight for counterbalancing said jib and loads carried from said jib by said hoist rope, the improvement comprising a holding and raising device mounted on said upper chassis, said holding and raising device being operative to pick up from the ground an additional removable counterweight and to hold said counterweight, said means connecting said strut to said jib includes guy rope means.

9. A crane as claimed in claim 8, further comprising sheave means on said strut and sheave means on said jib and wherein said guy rope extends from an upper fixed point on said jib to sheave means on said strut and thence to at least one further sheave means on said jib disposed below said fixed point, and further comprising guy rope winding drum means on said upper chassis, said guy rope means extending from said at least one further sheave means on said jib to said guy rope winding drum means.

10. A crane as claimed in claim 9, in which said guy rope extends to and fro between sheave means on said jib and sheave means on said strut to form a tackle extending between said jib and said strut.

11. In a mobile crane including a carriage, an upper chassis, means mounting said upper chassis on said carriage for rotation about an upright axis, a telescopic jib, means pivotally mounting said telescopic jib on said upper chassis for luffing movement about a substantially horizontal axis, a hoist rope, means for winding in and unwinding said hoist rope, a counterweight and means mounting said counterweight for counterbalancing said jib and loads carried from said jib by said hoist rope, the improvement comprising a holding and raising device mounted on said upper chassis, said holding and raising device being operative to pick up from the ground an additional removable counterweight and to hold said counterweight, said holding and raising device includes a strut means directly connecting said holding and raising device to said telescopic jib, sheave means on said jib and sheave means on said strut, and said hoist rope extending from said upper chassis via said sheave means on said jib and said sheave means on said strut and thence to an upper end of said jib.

12. A crane as claimed in claim 11, further comprising additional sheave means on said jib, additional sheave means on said strut and guy rope means extending around said additional sheave means on said jib and said additional sheave means on said strut, said sheave means and said additional sheave means on said jib being integrated to form sheave blocks and said sheave means and said additional sheave means on said strut being integrated to form a further sheave block.

* * * * *